US005277720A

United States Patent [19]

Fears

[11] Patent Number: 5,277,720

[45] Date of Patent: Jan. 11, 1994

[54] METHOD OF PREPARING AN EXPOSED SURFACE OF MARINE STRUCTURES TO PREVENT DETRIMENTAL ADHERENCE OF LIVING ORGANISMS THERETO

[76] Inventor: Clois D. Fears, 487 Cole Rd., Murrysville, Pa. 15668

[21] Appl. No.: 895,325

[22] Filed: Jun. 8, 1992

[51] Int. Cl.[5] ..... B63B 17/00; E04F 13/08

[52] U.S. Cl. ..... 156/71; 422/6; 422/8; 428/49; 428/472; 428/907; 114/356; 114/361

[58] Field of Search ..... 428/49, 472, 907; 422/6, 8; 156/74; 114/67 R; 114/222; 114/356; 114/361

[56] References Cited

U.S. PATENT DOCUMENTS

| | | | |
|---|---|---|---|
| 3,607,607 | 9/1971 | Beninga et al. | 428/49 |
| 3,784,357 | 1/1974 | Migraoka | 422/6 X |
| 3,804,689 | 4/1974 | O'Connor | 156/233 |
| 4,124,732 | 11/1978 | Leger | 428/49 X |
| 4,401,703 | 8/1983 | Rodgers | 428/907 X |
| 4,545,286 | 10/1985 | Fedij | 89/36.08 X |
| 4,568,586 | 2/1986 | Gobrecht | 428/49 |
| 4,603,653 | 8/1986 | Bews | 428/907 X |
| 4,690,793 | 9/1987 | Okamura et al. | 376/150 X |
| 4,814,227 | 3/1989 | Maeda et al. | 428/907 X |
| 4,987,036 | 1/1991 | Miller | 156/71 X |
| 5,080,926 | 1/1992 | Porter et al. | 422/6 X |

FOREIGN PATENT DOCUMENTS

| | | | |
|---|---|---|---|
| 2245922 | 1/1992 | United Kingdom | 114/67 R |

OTHER PUBLICATIONS

Hart, Matthew "Invasion of the Zebra Mussel," *The Atlantic Monthly*, Jul. 1990, pp. 81–87.

Graham Jr., Frank, "Talk of the Trail" *Audobon*, Sep. 1990, pp. 8, 10.

Reynolds, Clarence V., "Invasion of the Zebra Mussel," *Discover*, Jan. 1991, p. 44.

Bretz, Elizabeth A., "Zebra Mollusks: A Danger of a Different Stripe," *Electrical World*, Dec. 1990, pp. 72–74.

Steacy, Anne, "An Alien Invasion. Foreign Mussels Are Disrupting the Lakes," *Maclean's*, Nov. 6, 1989.

Cowley, Geoffrey et al., "Showdown at Mussel Beach. Marauding Crustaceans Terrorize the Great Lakes," *Newsweek*, Nov. 20, 1989, p. 66.

Voas, Sharon, "Zebra Mussels Show Up 965 Miles Downstream" *Pittsburgh Post Gazette*, Sep. 1992.

Fleming, Carrol B., "Ballast Water Stowaways," *Sea Frontiers*, Jun. 1991, p. 23.

"The Fleet Strikes Back at Zebra Mussels," *Seaway Review*, Oct.–Dec. 1991, p. 83.

Walker, Tim, "Dreissena Disaster: Scientists Battle an Invasion of Zebra Mussels," *Science News*, vol. 139, (May 1991), pp. 282–284.

Laszewski, Charles, "Striped Menace: Zebra Mussels Found in Mississippi River," *Underwater USA*, Nov. 1991, p. 20.

*Primary Examiner*—David A. Simmons
*Assistant Examiner*—Mark A. Osele
*Attorney, Agent, or Firm*—James Ray & Associates

[57] ABSTRACT

The present invention discloses a method of preventing detrimental adherence to and buildup of living marine organisms on exposed surface areas of a preselected component which is subjected to contact with a fluid medium that contains certain marine organisms. The methodology comprises the steps of preparing that portion of the component's exposed surface which contacts the fluid medium in a manner which will enable the adherence of a preselected anti-fouling agent to at least a portion of that exposed surface. After preparation, the preselected anti-fouling agent is applied.

4 Claims, No Drawings

METHOD OF PREPARING AN EXPOSED SURFACE OF MARINE STRUCTURES TO PREVENT DETRIMENTAL ADHERENCE OF LIVING ORGANISMS THERETO

INCORPORATION BY REFERENCE

The following applications are incorporated by reference into the subject application: METHOD OF, COATINGS AND LININGS FOR WATER INTAKE SYSTEM COMPONENTS AND OTHER EQUIPMENT EXPOSED TO A MARINE ENVIRONMENT, filed Nov. 8, 1991 with Ser. No. 07/790,259 and A COMPOSITION OF MATTER FOR LINING, COATING OR MANUFACTURING UNDERWATER STRUCTURES TO PREVENT LIVING MARINE ORGANISMS ADHERING TO OR BUILDING UP ON EXPOSED SURFACES, filed Apr. 22, 1992 with Ser. No. 07/827,017. A continuation-in-part was filed for the November 8th application on Mar. 2, 1992. The CIP has received the Ser. No. 07/844,502. The information disclosed in these applications has been incorporated herein by reference thereto.

FIELD OF INVENTION

The subject application relates to a method of applying an adhesive layer or coating to underwater components to prevent the adhesion and buildup of detrimental foreign substances, including but not limited to marine micro-organisms, on the surfaces exposed to the fluid medium. More specifically, the present invention relates to a method of coating, spraying or dipping a structure with a layer of epoxy-type adhesive of predetermined thickness. The adhesive is combined with an anti-fouling agent and the mixture is allowed to cure prior to submergence into the fluid medium.

BACKGROUND OF THE INVENTION

It is a well recognized problem with modern power generation plants, which require relatively large volumes of water for operation, that there is a potential loss of water from the adherence to and buildup of a variety of foreign substances on any surfaces exposed to the water or fluid medium, in general. The exposed surfaces include the inner surfaces of the water intake pipes, valves, fittings, heat exchangers, etc, and the outer surfaces of screens (rotary and bar), etc. Power generating plants and other manufacturing facilities which require the use of a particular medium, such as fresh water, have long sought an effective method of keeping the fluid transport system operational and free of any buildup of foreign organisms or debris.

One such foreign organism of particular concern and discovered recently is the D. polymorpha or zebra mollusk. The zebra mollusk is more commonly referred to as a zebra mussel. To illustrate the severity of the problem, the origin and problems associated with the zebra mussel has been documented in numerous magazines and periodicals including an article published in the December, 1990 issue of "Electrical World" on pages 72–74 and another article published in the July, 1990 issue of "The Atlantic Monthly" on pages 81–87. The information disclosed in these particular articles has been incorporated herein by reference thereto.

Prior to the present invention, when the fluid transport systems of present day technology exhibit any significant diminished capacity due to clogging by foreign substance buildup, one method used for cleaning the submerged piping system is pulling a dragging device through the submerged piping system to dislodge the buildups or clogs and subsequently to pull them through to the exit for manual cleanup. There are significant drawbacks to this prior art method which are readily apparent and would, for example, include the fact that this method is not only labor-intensive but time-consuming. Furthermore, this method cannot be accomplished continuously, but must be done on a regularly scheduled basis.

Another cleaning method which has been used for industrial facilities, such as water treatment plants, includes flushing the fluid transport system with relatively large quantities of chemicals. These chemicals are known to include chlorine and potassium chloride. While this prior art process can normally be conducted in a continuous manner, it is not efficient or cost-effective to induce large quantities of these chemicals into the fluid medium. Depending on the end use of the fluid, these chemicals, may themselves be detrimental. When this occurs, the chemical must be separated out.

As discussed in the above-referenced articles, at least three types of problems have already been identified with zebra mussel fouling in water intake systems. Initially, layers of attached mussels will reduce or block flow, even through large diameter piping, trash racks, and traveling screens. Eventually, shells or clumps of shells breaking free of their attachment sites can block openings in piping, heat exchangers, strainers, or traveling screens. Finally, attachment points of the organisms accumulate other debris which even further reduce water flow and serve as sites for corrosion.

At the present time, there are three EPA-approved chemical methods that have been tried in United States power plants. These chemical methods are chlorination, which has been the most discussed method in the incorporated articles; bromination, primarily Acti-brom, a Nalco Chemical Co. (Naperville, Ill.) product; and Betz Laboratories (Trevose, Pa.) Clam-Trol. Several other chemical treatments have been tried in laboratory tests, but not in a utility or industrial environment. As previously stated, chlorination is the most commonly used chemical control for zebra mussel fouling. It has been reported that continuous chlorination at 0.3 ppm not exceeding three weeks is required to achieve efficacy. However, intermittent chlorination programs that feed a few hours daily have generally been found to be ineffective. Using other chemicals, such as ozone, hydrogen peroxide, and potassium permanganate is possible. Use of these chemicals, however, is expensive, environmentally unsound, and/or impractical to distribute throughout a fluid transport system.

In terms of current technology, it has been reported that Detroit Edison is attempting to control zebra mussels by scraping and hydroblasting during its regular maintenance periods. Janiece Romstadt has received permission from the Federal government to use a commercial mollucicide. Ontario Hydro is treating some of its coolant with hypochlorite, an oxidant that eats away at the soft parts of the organism and is the active ingredient in household bleach. Ontario Hydro admits, however, that this short-term solution is offensive to a public anxious about the environment. Thus, one proposed alternative to this environmental drawback is ozonation. Like hypochlorite, ozone is an oxidant but it is also environmentally benign. Unfortunately, this method is extremely expensive. Ontario Hydro has estimated that use of ozonation would cost the corporation approximately $9 million per plant per year.

One member of the United States Fish and Wildlife Service estimates that the bill for re-engineering, maintenance and other forms of mussel abatement will total almost half a billion dollars per year. However, none of the current emergency measures, though they may alleviate specific problems on an ad hoc basis, will do anything to halt the overall proliferation of zebra mussels. The mussels are very strongly byssate and a mussel will attach to insides and occlude the openings of industrial and domestic pipelines, clog underground irrigation systems of farms, greenhouses, and any other facility that draws water directly from the Great Lakes, encrust navigation buoys to the point of submerging them, and encrust hulls of boats and other types of sailing craft that remain in the water over the summer and fall. The mussels may also form a significant vector of parasites that are lethal to game species of waterfowl and fish.

A United States Fish and Wildlife Service toxicologist reported in a news article featured in the November, 1991 issue of "Underwater USA" that the tiny but dreaded zebra mussel has been discovered for the first time in a section of the Mississippi River near La Crosse, Wis.

Another expert says that he expects to see the zebra mussel population explode by next year. Worse, it is likely boaters will inadvertently introduce the zebra mussel to the Minnesota lakes. The mussels have an extremely hard shell and clog water intakes at power plants and municipal water systems. The Monroe, Mich. water supply was crippled for three days when the mussels clogged a water intake pipe. As a result, water bills were increased eighteen percent to pay for the cost of removing them. An Ontario electric company spent $10 million on chlorine to keep the mussels out of its power plant water intake pipes. This expert expects the same things to happen at power and water plants on the Mississippi River. He states that locks and dams also are favored by the mussels, which have the potential to cause leaks and even to prevent control gates from closing completely.

The Applicant is aware of another material presently being marketed to control marine fouling of boat hulls. This material was developed by a chemical company in the eighties. Use of this material, however, is difficult and to date has not been tried on fluid transport systems. Also, the material requires a considerable amount of preparation of the substrate before it can be applied. Specifically, in terms of preparation, the material includes a primer. This primer is a very low viscosity, 100% epoxy undercoat. Like a wood preservative, the primer has a very high "wicking" characteristic. Thus, only one light coat of primer is required and it may be sprayed without thinning. Subsequently, one quart of the primer will cover approximately 400 square feet (approximately the wetted surface of a 42 foot full keel sailboat). This is a tack coat and should be applied similar to a wax as opposed to a paint application. A thick tack coat will cause the subsequent top coat of the material to run or bleed. The primer will cure to a "tacky" surface in 3 to 4 hours. It is only to be used as an undercoat and will oxidize if not covered with a finish coat. The finish coat may be applied at anytime after the surface becomes "tacky" to the touch, but should be applied within an eight hour time-frame window.

Preparation of the top coat material can now be discussed. This material is subject to settling and seven different ingredients are used to obtain its unique qualities of strength, flexibility, electrical-resistance, and anti-fouling properties. To assure uniformity, the epoxy base ("Part A") of the material must be thoroughly mixed to a homogenous "cake icing" consistency before adding the hardener or activator ("Part B"). Mixing should be done using an electric drill and a paint mixing agitator. It is a good practice to mix Part A each time prior to removing sub-lots from the primary container. If applicable, care should also be taken to ensure that the agitator has no protruding edges that may cut the plastic of the primary container. Experience has shown that plastic slivers can get in the mix and ultimately clog the spray nozzle. In addition, the hardener (Part B) must be thoroughly mixed before adding it to Part A. Three parts by volume of Part A, the epoxy base, is mixed with one part by volume of Part B, the hardener-/activator. Ultimately at 70 degrees F. the mixture has the consistency of a dry wall joint compound. Heated to 110 degrees F. the consistency alters to that similar to a latex paint. The potlife at 70 degrees F. is about one hour, and at 105 degrees F. is about 20 minutes.

The material would now be ready for application. However, one serious concern with the material is that careful attention must be paid to the application time-frame window for the material. Specifically, the material should be applied while the primer is still "tacky". If the application window is missed, the surface should be re-profiled with 60–80 grit sandpaper, cleaned, and lightly covered again with the primer before proceeding. The material is then applied using a standard cup gun which is commonly used in automobile painting. Part A and Part B are added to the cup in the proper proportions and blended. Next, a 15–20% solvent is added to the cup and the cup is immediately closed. After tightly sealing the cup, the components are mixed by shaking and swirling the gun. A spray of approximately 60–80 psi air pressure is commenced.

In terms of the spray, a 0.001–0.002 inch thick tack coat is first sprayed over the primer and then followed within the next 10 to 45 minutes by a 0.004–0.005 inch thick coat. Next, a full 0.003–0.005 inch coat is applied until a finish thickness of 0.017–0.020 inch has been obtained. Re-coats may be applied every 10 to 15 minutes at 70 degrees F. Runs in the coats may occur if the prescribed applications are too thick, subjected to very warm environments, or exposed to direct sunlight. Lastly, another disadvantage of this material is that operator/applicator judgment becomes critical when the individual applications are done at less than ideal conditions.

If the cup gun does not have an agitator, the gun must be frequently shaken with a rapid wrist motion to keep a uniform mixture. Also, a pressure pot may be used for larger jobs. A working combination of a Bink's model 7 gun, a 2 gallon Bink's pot with agitator (model #83-5508), an air regulator (model #85-204) and a 38 PM nozzle have been used successfully in the application process. However, the 38 PM nozzle is quite large (about 0.086") and the operator may prefer a nozzle in the 0.060 range to obtain greater control of the overall film thickness.

The material should be allowed to cure for twenty-four to forty-eight (24 to 48) hours, depending on the ambient conditions prior to activation. The activation step is very important because barnacles will grow on any unactivated material. Next, the operator has options such as lightly sandblasting with either a wet or dry 40F grit or finer to activate the surface or to lightly sand with 220 wet/dry paper to remove blush. However, the longer the cure time before activation, the easier it will be to activate the material successfully. Optimally, the operator should allow the material to cure continuously for a week at 70 degrees F.

Finally, although the described material has been formulated for a high moist environment and will even cure underwater, for best results the material should not be applied to damp surfaces.

Although the above-mentioned technology has numerous inherent drawbacks such as the difficulties associated with the material's manufacture and application, the development of a method to successfully and simply coat specific components and existing structures would prove to be a viable method to prevent the adherence of organisms. Specifically, fluid transport systems which have components such as screens of various sizes cannot be fully lined, thus coating the structures will be a workable alternative. Coating will allow the water or fluid medium to pass through the porous openings or meshing of the screen but it will prevent the marine organisms from attaching.

A coating process will also prove to be invaluable in instances where components such as screens are small or located within (hard to reach) other structures such as valves. For instance, with screen components located within valves even a simplistic abrading technology would prove to be awkward and possibly even impossible to use. Thus, the best method for maintaining these structures would be attacking foreign substances or living marine organisms with a coating spray initially or retroactively applied to prevent the adherence and buildup of the foreign substance.

Therefore, based on the history and detrimental effects already known and attributed to the zebra mussel, it is apparent that it is critical to create a fluid transport system in which the pipes and other system components are coated with a material which would substantially minimize the initial adherence to and eventual buildup of foreign substances on the inner surfaces of the pipes and the exposed surfaces of other system components while they are submerged in a fluid medium.

SUMMARY OF THE INVENTION

In a first aspect, the present invention provides a method of preventing detrimental adherence to and the subsequent buildup of foreign substances on exposed surface areas of a component subjected to contact with a fluid medium which contains the foreign substance. The types of foreign substances which can be addressed includes but is not limited to living marine organisms. The basic methodology includes the steps of applying an adhesive layer of a predetermined thickness to the exposed surface area of the component which will be subjected to contact with the fluid medium and ultimately to the foreign substance itself. Next, the adhesive layer is applied with a pre-selected anti-fouling agent. Finally, the adhesive layer is cured causing the anti-fouling agent to be adhered to the adhesive layer. The adhesive layer can consist of an epoxy-type adhesive.

Further, the basic methodology can include the additional step or steps of either mixing a hardening agent into an epoxy resin and applying the adhesive layer by spraying or dipping the subject component. The setting time of the adhesive can be controlled by preforming the material in a cold room. Also, the exposed surface can be initially cleaned and pitted to both remove any foreign matter adhering to the component and to provide enhanced mechanical bonding of the anti-fouling agent. However, when the component has been dipped, the method may also include the additional step of removing any excess adhesive.

The anti-fouling agent can be selected from the group consisting of copper, copper compounds, organotin, zinc, zinc compounds or various mixtures thereof. The copper anti-fouling agent can be made of powdered copper metal. The powder should have a particle size which is at least sufficient to provide adequate surface area to achieve a good bond. Specifically, the powder's particle size should be such that at least ninety (90.0%) percent will pass through a component of 320 mesh.

The curing of the adhesive layer with the anti-fouling agent may also include an initial heating step.

In an embodiment of the present invention wherein the component is plastic, the methodology can include the steps of liquefying the exposed surface areas and then subsequently allowing the exposed liquefied area to reharden. The component can be liquefied through the application of heat or a solvent. Also when the component has been liquefied, pressure can be added to embed a preselected anti-fouling agent into the exposed area.

In addition to this methodology, another embodiment of the present invention provides a method which focuses specifically on preventing the detrimental adherence and buildup of living marine organisms. This method includes the step of forming an epoxy-type adhesive by mixing a hardening agent into an epoxy resin. Next, a layer of predetermined thickness of this adhesive is applied to the exposed surface areas of the component. The adhesive layer is then coated with a preselected anti-fouling agent. Once again, the anti-fouling agent should be selected from the group consisting of copper, copper compounds, organotin, zinc, zinc compounds or a mixture of the group's constituents. Finally, the adhesive layer is cured to adhere the adhesive layer and selected anti-fouling agent together.

Further with this embodiment, if the chosen anti-fouling agent is copper, the copper can consist of a powdered copper metal. The metal powder should have a particle size in which at least ninety (90.0%) percent will pass a 320 mesh.

The methodology can include a spraying step. Also, prior to beginning the initial adhesive forming step, the method can include the additional step of cleaning the exposed surface area of the component to remove any foreign matter which is adhering to it.

The present invention also discloses an embodiment in which the adhesive layer must be coated with a anti-fouling layer selected from the group consisting of copper, copper compounds, organotin, zinc, zinc compounds and mixtures thereof. In this embodiment the anti-fouling layer will include both copper and organotin.

In a further embodiment of the invention, tile can be adhered to the exposed surface area of a component to protect against the detrimental adherence and buildup of marine microorganisms. The tile will be comprised of a refractory member of predetermined shape with an adjacent preselected anti-fouling agent on the outer surface of the refractory member. The tile can be ceramic.

Lastly, the present invention discloses embodiments which includes the methods of adhering either a refractory or tile-like member, both of which can incorporate a preselected anti-fouling agent, to a component's exposed surface areas. The preferred adhesive for these methods will be concrete including approximately 10 to 25% copper. However, other known tiling adhesives are within the scope of the present invention.

OBJECTS OF THE INVENTION

It is, therefore, one of the primary objects of the present invention to provide a method for applying an adhesive layer to the exposed surfaces of components in a fluid medium to prevent the detrimental adherence to and buildup of living marine organisms on those surfaces.

Another object of the present invention is to provide a low cost solution to the buildup of detrimental foreign substances on the exposed surfaces of components in a fluid medium.

Still yet another object of the present invention is to provide a composition of matter in which a number of anti-fouling agents can be incorporated therein.

Yet still another object of the present invention is to provide a coating material for screens used in underwater fluid transport systems.

An additional object of the present invention is to provide a method of protecting exposed surface areas of underwater structures against both detrimental adherence to and buildup of living marine organisms utilizing a composition of matter specifically formulated for this application and applied to such exposed surface areas.

A still further object of the present invention is to provide a method of coating components to prevent the adherence and subsequent buildup of zebra mussels.

Another object of the present invention is to provide a method of coating underwater components with a material which is easy to manufacture, simple to apply and has a short preparation time.

A further object of the present invention is to provide a method of coating underwater components with a material which can successfully be applied without removing the subject structure from the fluid medium.

Still yet another object of the present invention is to provide a method for coating small components, hard to reach components, or embedded components within larger structures of the overall fluid transport systems.

An additional object of the present invention to provide a method for adding a preselected anti-fouling agent to plastic components.

Another object of the present invention is to teach the use of tile which combines a refractory member and a preselected anti-fouling agent to protect exposed surface areas on components.

Still yet another object of the present invention is to provide a method to adhere a refractory or tile-like member to the exposed surfaces of a component.

In addition to the above described objects and advantages of the present invention, various other objects and advantages of the invention will become more readily apparent to those persons who are skilled in the marine organism anti-fouling art from the following more detailed description, particularly, when such description is taken in conjunction with the appended claims.

DESCRIPTION OF THE INVENTION

The present invention is directed to a method of producing a material that has been specifically formulated for use on an exposed surface area of an existing predetermined underwater structure. This material or composition of matter can be used as a coating on the exposed surface areas of these structures.

During the normal use of these underwater structures the surface areas are exposed to living marine organisms which can both detrimentally adhere to and buildup on the exposed surface areas. The composition of material taught herein is at least capable of substantially minimizing this detrimental adherence to and buildup of living marine organisms of the exposed surface areas of such predetermined underwater structures during its normal use. One of the marine organisms specifically discussed in this disclosure is the zebra mussel.

According to the present invention the method of applying the coating material includes the first step of layering an adhesive material of predetermined thickness onto the exposed surface of the component. Methods which can be used to achieve this initial layering are either spraying the adhesive onto the surface of the component or alternately, dipping the component into the adhesive material itself. If the component has been dipped, it will be advantageous to remove any excess adhesive. The predetermined thickness applied will be at least about one-sixteenth of an inch thick. Preferably this minimum thickness will be in a range of between about one-quarter of an inch and about one inch.

In terms of the adhesive, it is preferable to use an epoxy-type material. It is also advantageous to mix a hardening agent into this epoxy resin.

Another essential element of the material and method, according to the present invention, is a preselected anti-fouling agent. This preselected anti-fouling agent is coated over the adhesive layer in an amount which is at least sufficient to provide such component the capability of substantially minimizing both any detrimental adherence to and buildup of the living marine organisms on the exposed surface areas of the underwater structures.

In the presently preferred embodiment the preselected anti-fouling agent coated on the adhesive layer is selected from the group consisting of copper, copper compounds, organotin, zinc, zinc compounds and various mixtures thereof. If copper is chosen in this preferred embodiment, the copper should be used as a powdered copper metal which has a particle size in which at least about ninety (90.0%) percent will pass a 320 mesh. Another preferred embodiment has the copper mixed with the organotin.

Finally, the method includes the step of combining the adhesive layer and anti-fouling agent through curing. The preferred embodiment may include the additional step of heating the component during the curing period.

It may also be desirable for the method to include the additional step of cleaning the surface of the component prior to applying the initial layer of adhesive. This cleaning step should remove any foreign matter clinging to the component and will create a better surface for application of the adhesive layer.

It is also within the scope of the present invention for the predetermined minimum thickness of material to be applied to the exposed surface areas of predetermined underwater structures while the component is still submerged beneath a surface of the fluid medium. In this case, the method must include the additional step of evacuating the fluid medium to expose the surface areas to be coated with the material.

Finally, it is also within the scope of the present invention for such predetermined minimum thickness of material to be applied as a spray coating for small components, for components which are hard to reach or for components which are embedded structurally within other larger structures.

While a number of presently preferred and alternative embodiments of the invention have been discussed in considerable detail above, it should be obvious to those persons who are skilled in the art that various other modifications and adaptions of the present invention can be made without departing from the spirit and the scope of the appended claims.

I claim:

1. A tile adhered to exposed surface areas of a component which is subjected to contact with a fluid medium containing living marine organisms to protect such exposed surface areas from detrimental adherence to and build up of such marine organisms on such exposed surface areas, said tile comprising;

(a) a refractory member having a predetermined shape adhered to an exposed surface area of a component subjected to contact with a fluid medium containing living marine organisms; and (b) a preselected anti-fouling agent at least adjacent an exposed surface of said refractory member subjected to contact with a fluid medium containing living marine organisms.

2. A tile, according to claim 1, wherein said refractory member is ceramic.

3. A tile, according to claim 2, wherein said anti-fouling agent is selected from the group consisting of copper, copper compounds, organotin, zinc, zinc compounds and various mixtures thereof.

4. A method of preventing detrimental adherence to and build up of living marine organisms on exposed surface areas of a preselected component which is subjected to contact with a fluid medium that contains such marine organisms, said method comprising the steps of:

(a) providing a refractory member in the form of a tile, said refractory member having;

(i) a predetermined shape capable of being adhered to an exposed surface area of a component subjected to contact with a fluid medium containing living marine organisms, and (ii) a preselected anti-fouling agent at least adjacent an exposed surface of said refractory member subject to contact with a fluid medium containing living marine organism; and (b) adhering said refractory member to said exposed surface areas of said component.

* * * * *

UNITED STATES PATENT AND TRADEMARK OFFICE

CERTIFICATE OF CORRECTION

PATENT NO. : 5,277,720

DATED : 1/11/94

INVENTOR(S) : Clois D. Fears

It is certified that error appears in the above-indentified patent and that said Letters Patent is hereby corrected as shown below:

Column 4, line 19, please delete "-".

Signed and Sealed this

Twenty-fourth Day of May, 1994

Bruce Lehman

*Attest:*

BRUCE LEHMAN

*Attesting Officer*

*Commissioner of Patents and Trademarks*